US012529267B2

(12) United States Patent
Fitzgerald et al.

(10) Patent No.: US 12,529,267 B2
(45) Date of Patent: Jan. 20, 2026

(54) MULTI-FUNCTIONAL WELLBORE CONDITIONING SYSTEM

(71) Applicant: EUROPEAN DRILLING PROJECTS B.V., Amsterdam (NL)

(72) Inventors: Tony Fitzgerald, Leiden (NL); Michael Thomas Newman, Tuitjenhorn (NL)

(73) Assignee: EUROPEAN DRILLING PROJECTS B.V., Amsterdam (NL)

( * ) Notice: Subject to any disclaimer, the term of this patent is extended or adjusted under 35 U.S.C. 154(b) by 0 days.

(21) Appl. No.: 18/714,634

(22) PCT Filed: Nov. 25, 2022

(86) PCT No.: PCT/EP2022/083245
§ 371 (c)(1),
(2) Date: May 30, 2024

(87) PCT Pub. No.: WO2023/104540
PCT Pub. Date: Jun. 15, 2023

(65) Prior Publication Data

US 2025/0020026 A1 Jan. 16, 2025

(30) Foreign Application Priority Data

Dec. 6, 2021 (EP) ..... 21212615

(51) Int. Cl.
*E21B 10/26* (2006.01)
*E21B 7/28* (2006.01)
(Continued)

(52) U.S. Cl.
CPC ..... *E21B 10/26* (2013.01); *E21B 7/28* (2013.01); *E21B 10/567* (2013.01); *E21B 17/1078* (2013.01); *E21B 31/00* (2013.01)

(58) Field of Classification Search
CPC . E21B 10/26; E21B 7/28; E21B 10/56; E21B 10/567; E21B 17/1078; E21B 31/00
See application file for complete search history.

(56) References Cited

U.S. PATENT DOCUMENTS

2006/0201670 A1* 9/2006 Stewart ..... E21B 17/18 166/170
2012/0132469 A1* 5/2012 Robson ..... E21B 17/1078 175/73

(Continued)

FOREIGN PATENT DOCUMENTS

CN 103912225 A 7/2014
CN 109681121 A 4/2019

(Continued)

OTHER PUBLICATIONS

International Search Report and Written Opinion dated Feb. 7, 2023 for PCT Application No. PCT/EP2022/083245, 9 pages.

*Primary Examiner* — Caroline N Butcher
(74) *Attorney, Agent, or Firm* — Richard A. Fagin

(57) ABSTRACT

One-piece multi-functional wellbore conditioning system that combines reaming while drilling, wellbore conditioning, providing a plastering effect, improved stabilization and cleaning cuttings from a drilled hole. Said one-piece multi-functional wellbore conditioning system comprises two reamer stages and a drilling cuttings agitator positioned between the two reamer stages, wherein the drill cuttings agitator comprises a plurality of first, second and center stabilizing blades extending radially outwardly from the outer surface of the body of the drill cuttings agitator and a plurality of hydrodynamic flutes extending radially inwardly from the outer surface of the tubular body.

14 Claims, 12 Drawing Sheets

(51) Int. Cl.

| | |
|---|---|
| ***E21B 10/567*** | (2006.01) |
| ***E21B 17/10*** | (2006.01) |
| ***E21B 31/00*** | (2006.01) |

(56) References Cited

U.S. PATENT DOCUMENTS

| | | | | |
|---|---|---|---|---|
| 2016/0265287 | A1* | 9/2016 | Newman | E21B 17/1078 |
| 2017/0074054 | A1* | 3/2017 | Newman | E21B 17/1078 |
| 2017/0254149 | A1* | 9/2017 | Short, Jr. | E21B 10/26 |
| 2022/0195808 | A1* | 6/2022 | Bailey | E21B 10/26 |
| 2022/0298865 | A1* | 9/2022 | Sanchez | E21B 37/00 |

FOREIGN PATENT DOCUMENTS

| | | | |
|---|---|---|---|
| GB | 2473094 | A | 3/2011 |
| GB | 2485857 | A | 5/2012 |

* cited by examiner

Section: B-B

Section: D-D

MULTI-FUNCTIONAL WELLBORE CONDITIONING SYSTEM

CROSS-REFERENCE TO RELATED APPLICATIONS

This application is a National Stage 371 application claiming the benefit of International Application No. PCT/EP2022/083245, filed Nov. 25, 2022, which claims priority from European Patent Application No. 21212615.5, filed Dec. 6, 2021, the entire contents of which are incorporated herein by reference.

TECHNICAL FIELD

The present invention is directed to a downhole tool for a drill string for drilling oil, gas and water wells, namely a one-piece multi-functional wellbore conditioning system where said system combines reaming while drilling, wellbore conditioning, providing a plastering effect, improved stabilization and cleaning cuttings from a drilled hole.

BACKGROUND ART

As technology has advanced in the directional drilling industry, it has facilitated the drilling of deeper, and more complex well trajectories, faster than ever before.

Wellbore quality issues, whether related to either geometry, hole cleaning or formations could lead to the wellbore drift diameter being smaller, leading to increased friction, tight spots, higher upper rotary torque, leading to reduced actual weight and torque on bit, elevated levels of drilling vibrations and even unnecessary and premature bottom hole assembly (BHA) component wear.

In general, enlarging a borehole may be done as a separate operation to enlarge an existing borehole or be done in the same operation as drilling the borehole. The initial or pilot hole is drilled with the drill bit; a reamer can be positioned a distance above the bit to enlarge and/or condition the borehole. If a reamer has a fixed outer diameter, the cutting elements action starts at the wellbore surface and ends with a diameter equal to or greater in diameter than the drill bit. Alternatively, a reamer constructed with expandable cutters could be used. If the borehole requires slight enlargement and/or straightening due to the formation of doglegs, a reamer can be constructed to be eccentric; a reamer with this feature set is used to enlarge and or straighten the borehole by a fraction of an inch.

With increasing measured depths and horizontal displacements in extended-reach wells, cuttings transportation and good hole cleaning remains a major challenge. Hole cleaning is the ability of the drilling fluid, also referred as mud, to transport the cuttings produced during drilling operations up to the surface and suspend the cuttings. It has been recognized for many years that removal of the cuttings from the wellbore during drilling of horizontal wells poses special problems.

As the cuttings produced during drilling process are being transported to the surface, it has been found that some of the cuttings fall out of the drilling mud in inclined to horizontal wellbore sections, then they settle on the low side of the wellbore due to gravity and an accumulation of solids is formed along the lower side of the borehole. This and the fact that the drill string also lies on the wellbore's low side reduces the efficiency of the drilling process. Failure to achieve sufficient hole cleaning can cause severe drilling problems including excessive energy and time required when tripping out of the hole, high rotary torque, stuck pipe, hole pack-off, excessive equivalent circulating density, formation break down, slow rates of penetration and difficulty running casing and logs. These cuttings bed accumulations can result in the drill string getting stuck inside the hole, which in turn results in a major drilling cost. Although prevention of stuck string is far more economical, the drilling professional often opts for freeing procedures such as "washing and reaming," wherein the drilling fluid is circulated and the drill string is rotated as the bit is introduced into the wellbore, and "back reaming," wherein the drilling fluid is circulated, and the drill string is rotated as the bit is withdrawn from the wellbore. Other operations such as "wiper trips" or "pumping out of the hole" are often performed to attempt to control the amount of cuttings accumulated in the wellbore. All these operations require time and can significantly add to the cost of drilling a directional well. Therefore, there is a need to overcome those problems.

SUMMARY OF THE INVENTION

The object of the present invention in accordance with claim 1 is achieved by a one-piece construction multi-functional wellbore conditioning system having a tubular body extending along a longitudinal axis X, said system comprising a trailing eccentric reamer stage, a leading eccentric reamer stage, and

- a drill cuttings agitator being positioned between said trailing and leading eccentric reamer stages, wherein said drill cuttings agitator comprises a plurality of first stabilizing blades extending radially outwardly from an outer surface of the tubular body,
- a plurality of second stabilizing blades extending radially outwardly from the outer surface of the tubular body,
- a plurality of center stabilizing blades extending radially outwardly from the outer surface of the tubular body and arranged axially between the plurality of first stabilizing blades and the plurality of second stabilizing blades, and
- a plurality of hydrodynamic flutes extending in a longitudinal direction and extending radially inwardly from the outer surface of the tubular body,
- where each stabilizing blade of the plurality of first, second and center stabilizing blades is disposed along a circumference coaxial with the tubular body at 90 degrees apart from each other and where the plurality of center stabilizing blades is offset by 45 degrees from the preceding plurality of first stabilizing blades and the following plurality of second stabilizing blades, said flutes being positioned circumferentially between the center stabilizing blades.

The multi-functional wellbore conditioning system of the present invention is designed to improve the drilling efficiency by removing sections of parallel misalignment, key seats, micro doglegs, and sours up cutting beds that can lead to swabbing and pack-off issues. This is achieved by optimizing the placement of the eccentric reamer stages along the length of the tubular body which eccentric reamer stages have a low-torque helical hybrid cutting structure, combined with a flow accelerator and drilling cuttings agitator.

Said multifunctional wellbore conditioning system marginally increases the wellbore drift diameter through unique customizable eccentric reamer stages, a drilling fluid accelerator, a cutting bed agitator and a stabilizer, all combined within a single-piece design.

Said multi-functional wellbore conditioning system combines hole enlargement while drilling, also known as reaming while drilling, and hole cleaning in vertical, deviated, horizontal and extended reach wells.

Further improvements include smoothing the wellbore by removing dog legs, reducing drag values, improved tripping performance, improved hole cleaning and enhancing casing and cement installation processes.

Advantageously, the multi-functional wellbore conditioning system is of a one-piece construction, that is milled, molded, or machined from a single piece of material, having a tubular body with radius "r" and length I, defining a long axis "X" extending in a longitudinal direction.

Advantageously, the wellbore conditioning system has an eccentric reamer design, where the leading eccentric reamer stage and the trailing eccentric reamer stage are radially offset from the longitudinal axis "X" of the tubular body.

Advantageously, the leading and trailing eccentric reamer stages each have a set of cutting blades having a cutting structure i.e., polycrystalline diamond compact (PDC) cutter inserts and/or tungsten carbide inserts (TCIs) adapted to do most of the borehole enlarging and/or conditioning, and a set of drift blades adapted to dynamically stabilize the wellbore conditioning system during rotational reaming by minimizing the vibrations and provide a plastering effect on the wellbore.

Advantageously, the wellbore conditioning system has a drill cuttings agitator being positioned between the two eccentric reamer stages, where said drill cuttings agitator comprises a plurality of stabilizing blades and hydrodynamic flutes. The stabilizing blades are adapted to increase the velocity of the drilling fluid where the special geometry of said stabilizing blades creates pressure and turbulence at the low side of a horizontal well which pressure and turbulence is directed at the segmented concentration of cuttings, and as the wellbore conditioning system rotates this creates a scouring effect in the cutting beds. Said stabilizing blades also stabilize the wellbore conditioning system in the borehole. As the multi-functional wellbore conditioning system translates in a counter rotation downhole, the stabilizing blades agitate the cutting beds on the lower side of the wellbore pushing the cuttings up into the circulating drilling fluid where they are transported downstream. The agitation of the cutting beds leads to cleaner and more uniform flow conditions. The additional bearing pressure created against the wall of the wellbore and the increase in annular velocity combined with the stabilizing blades geometry leads to a smoother filter cake whilst minimizing the risk of pack off during drilling operation.

In general, in drilling applications, based on the blade shape, the blades can be helical blades or straight blades. All blades i.e., cutting, drift and stabilizing blades in the present invention are straight and parallel to the longitudinal axis X of the tubular body. The surface area of the straight blades is smaller than a helical one and therefore, straight blades have the advantage of lower friction resistance, diminishing the possibility of the drill string being stuck, and also improving the cuttings transport, backflow, and bit balling.

All these features of the present invention work in synergy to achieve all of the above-mentioned technical effects.

BRIEF DESCRIPTION OF THE DRAWINGS

FIG. 1 B depicts a cross-sectional view (section B-B) of the drill cuttings agitator 4 showing the center stabilizing blades 9 and also the hydrodynamic flutes 7 according to the claimed invention;

FIG. 1 C depicts a cross-sectional view (section C-C) of the drill cuttings agitator 4, showing the stabilizing blades 8 according to the claimed invention;

FIG. 1 D depicts a cross-sectional view (section D-D) of the leading eccentric reamer stage 3B, showing the drift blades 6B and cutting blades 5B;

DESCRIPTION OF THE INVENTION

As embodied and broadly described, the disclosures herein provide detailed embodiments of the invention. However, the disclosed embodiments are merely exemplary of the invention that may be embodied in various and alternative forms. Therefore, there is no intent that specific structural and functional details should be limiting, but rather the intention is that they provide a basis for the claims and as a representative basis for teaching one skilled in the art to variously employ the present invention.

Figure 1:
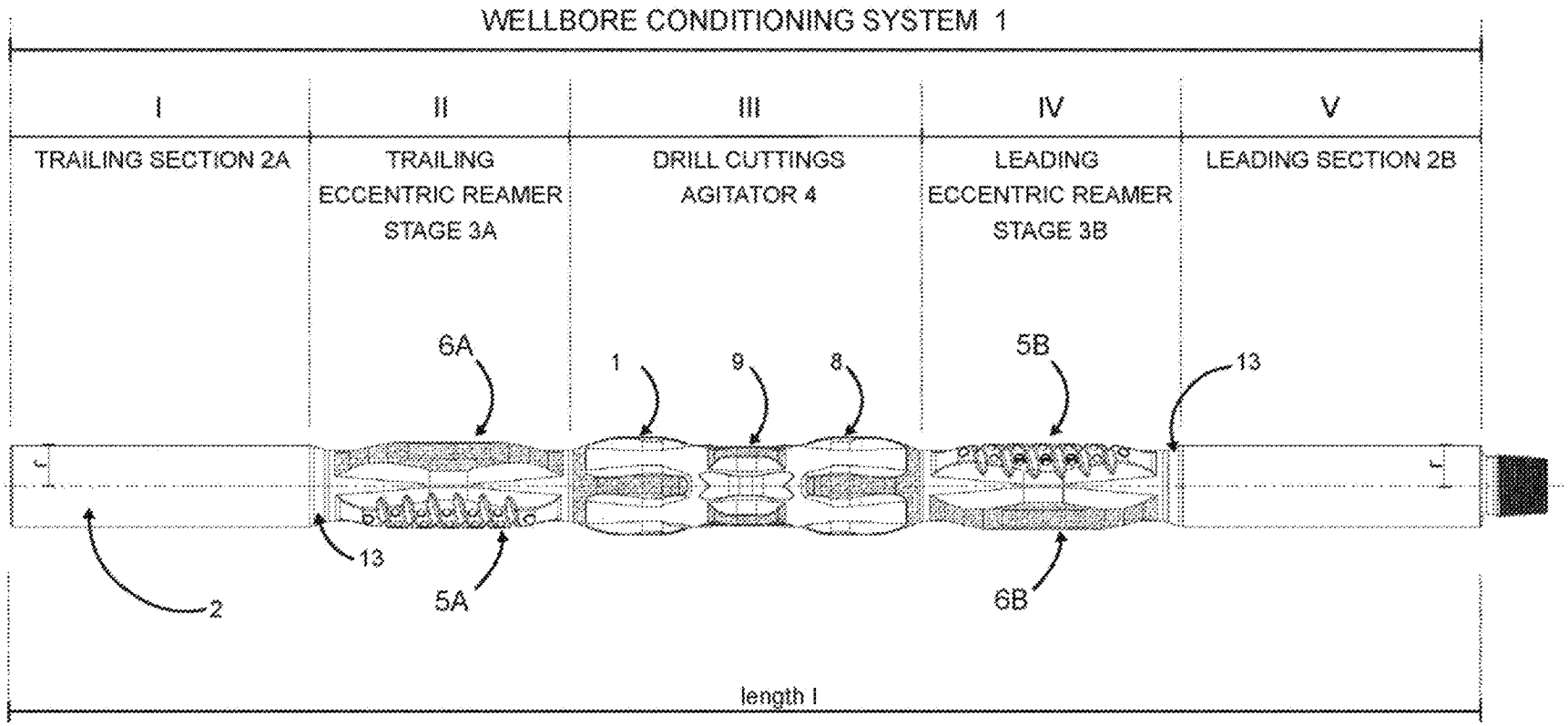
FIG. 1 is a schematic view of an embodiment of the wellbore conditioning system according to the claimed invention.

A one-piece multi-functional wellbore conditioning system 1 according to the invention is shown in FIG. 1. Said multi-functional wellbore conditioning system has a tubular body 2 with radius "r" and length "l", extending along a longitudinal axis X, where said tubular body is virtually divided into several sections along said longitudinal axis "X", i.e., section I-defined as trailing section 2A;
section II-defined as a trailing eccentric reamer stage 3A;
section III-defined as a drill cuttings agitator 4;
section IV-defined as a leading eccentric reamer stage 3B,
section V-defined as a leading section 2B.

Between any two consecutive sections in the longitudinal direction of the tubular body there is a frustoconical element 13 with an inclination of 15-20 degrees with respect to the longitudinal axis X. The frustoconical element narrows from section I towards section II, and from section V towards section IV, and from section III towards section II and IV respectively. This provides more efficient passage of the fluid over the blade lengths.

The multi-functional wellbore conditioning system 1, also referred to herein as "tool", comprises a first leading eccentric reamer stage, also referred to as "leading eccentric reamer stage" or "first eccentric reamer stage", and a second trailing eccentric reamer stage, also referred to as "trailing eccentric reamer stage" or "second eccentric reamer stage", and a drill cuttings agitator positioned between said first and second eccentric reamer stages, where said agitator comprises a plurality of stabilizing blades which have a curved surface along the longitudinal axis X of the multi-functional wellbore conditioning system. Said stabilizing blades increase the velocity of the drill cuttings from leading to trailing cutting blade set.

The wellbore conditioning system is manufactured from a single piece of steel, such as chromium-molybdenum high tensile steel, where said steel has mechanical characteristics which may correspond with other drill string components which connect onto said system. The leading and trailing eccentric reamer stages and the agitator are milled, molded, or machined from a single piece of material as an integral component of the tubular body of the wellbore conditioning system, forming a unitary piece, also referred to as one-piece construction.

Each eccentric reamer stage comprises a set of cutting blades and a set of drift blades. The cutting and the drift blades extend radially outwardly from the outer surface of the tubular body. Although the tool geometry of the present invention is designed for reaming, there is also the possibility of using this tool geometry as a stabilizer.

Figure 1A:
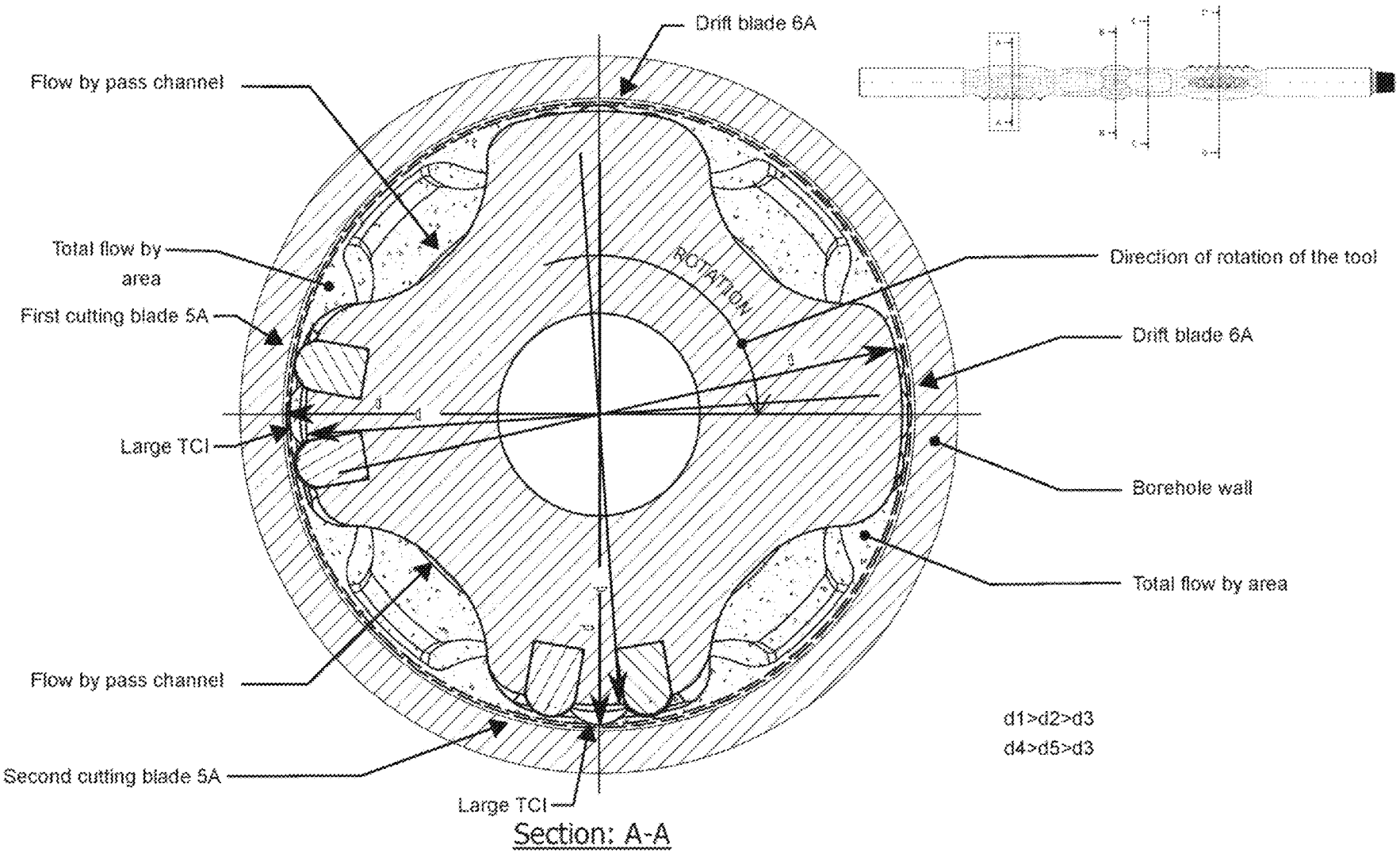
FIG. 1A depicts a cross-sectional view (section A-A) of the trailing eccentric reamer stage 3A showing the cutting blade 5A and the drift blade 6A according to the claimed invention.
Figure 1B:
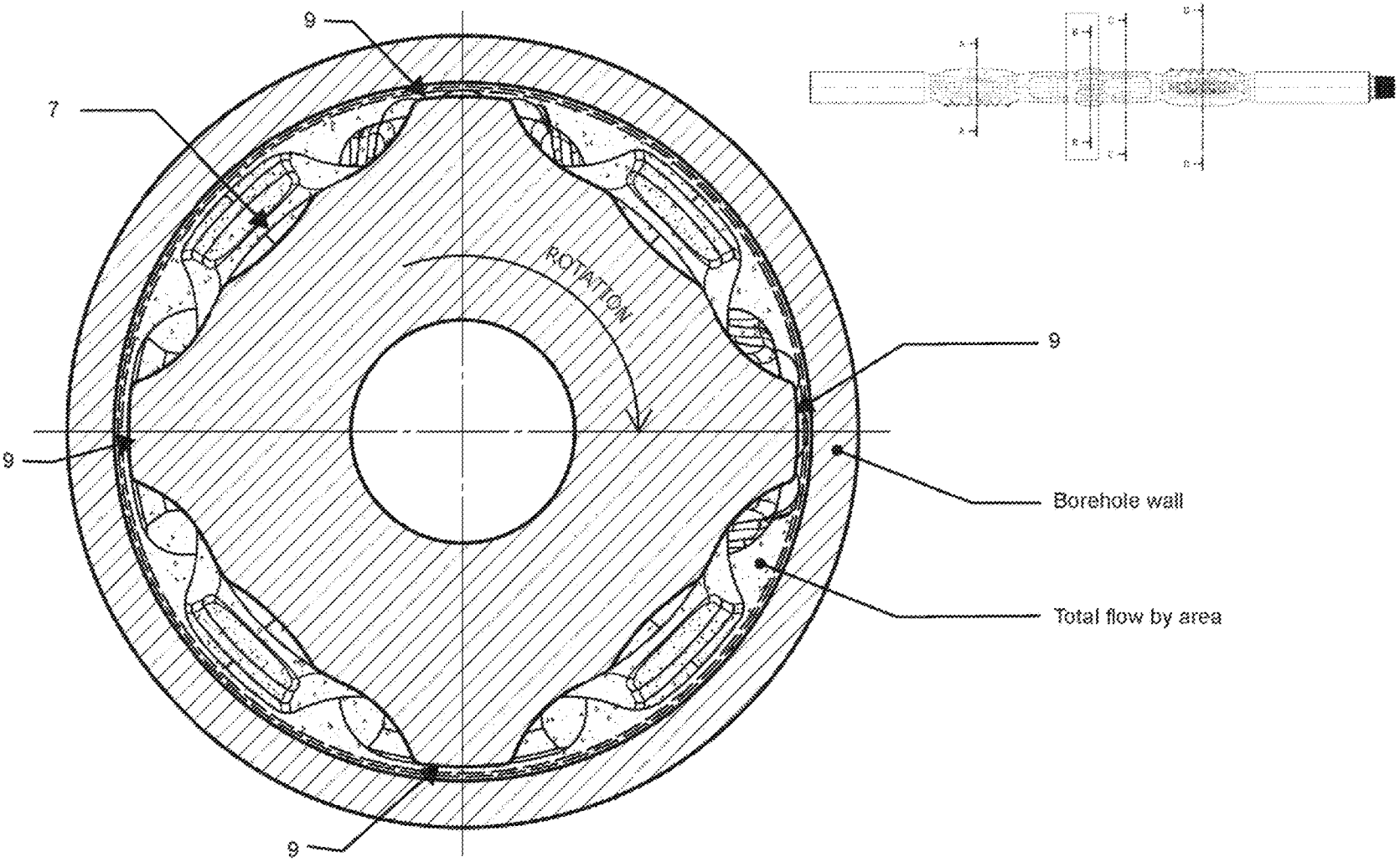
Figure 1C:
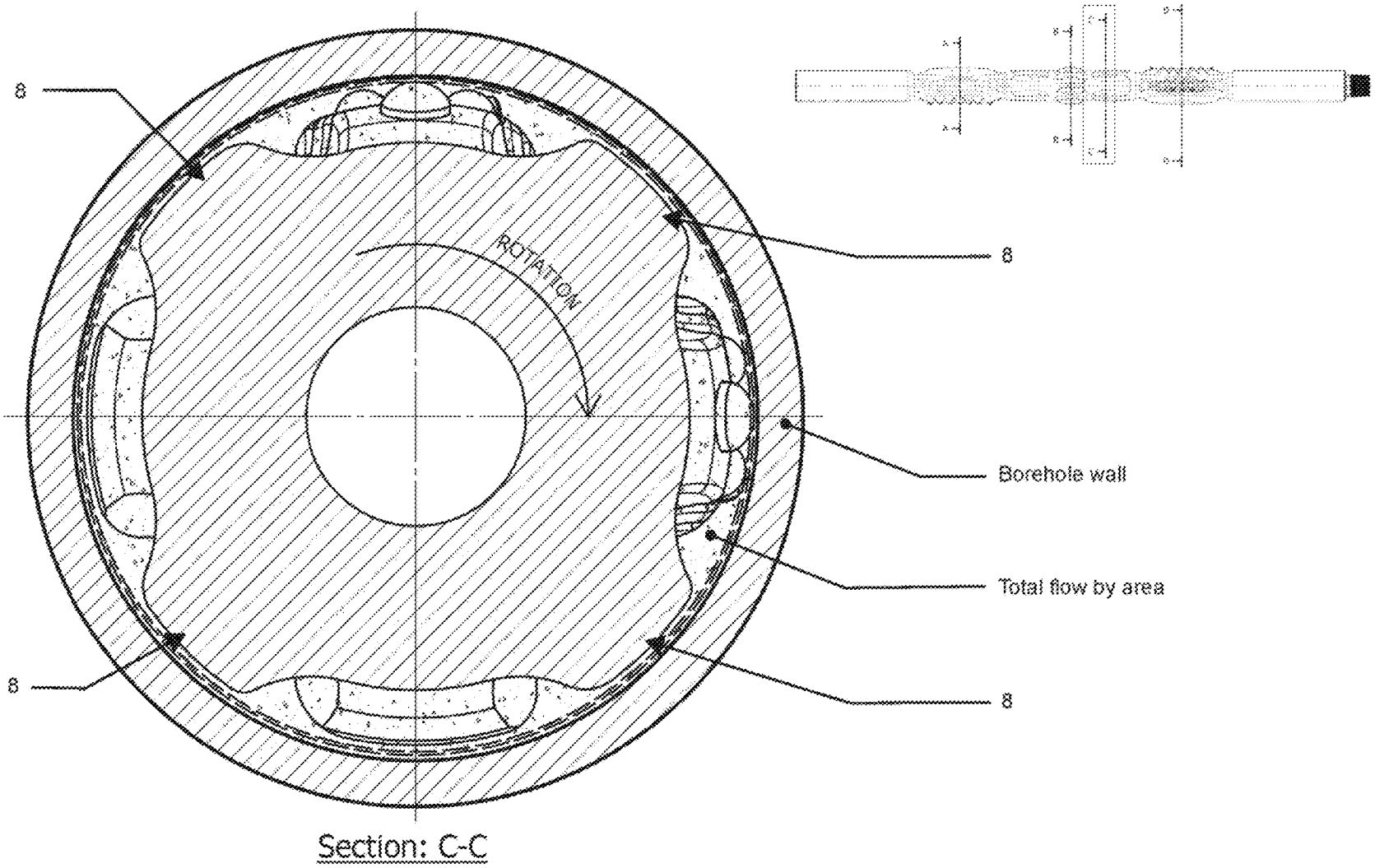
Figure 1D:
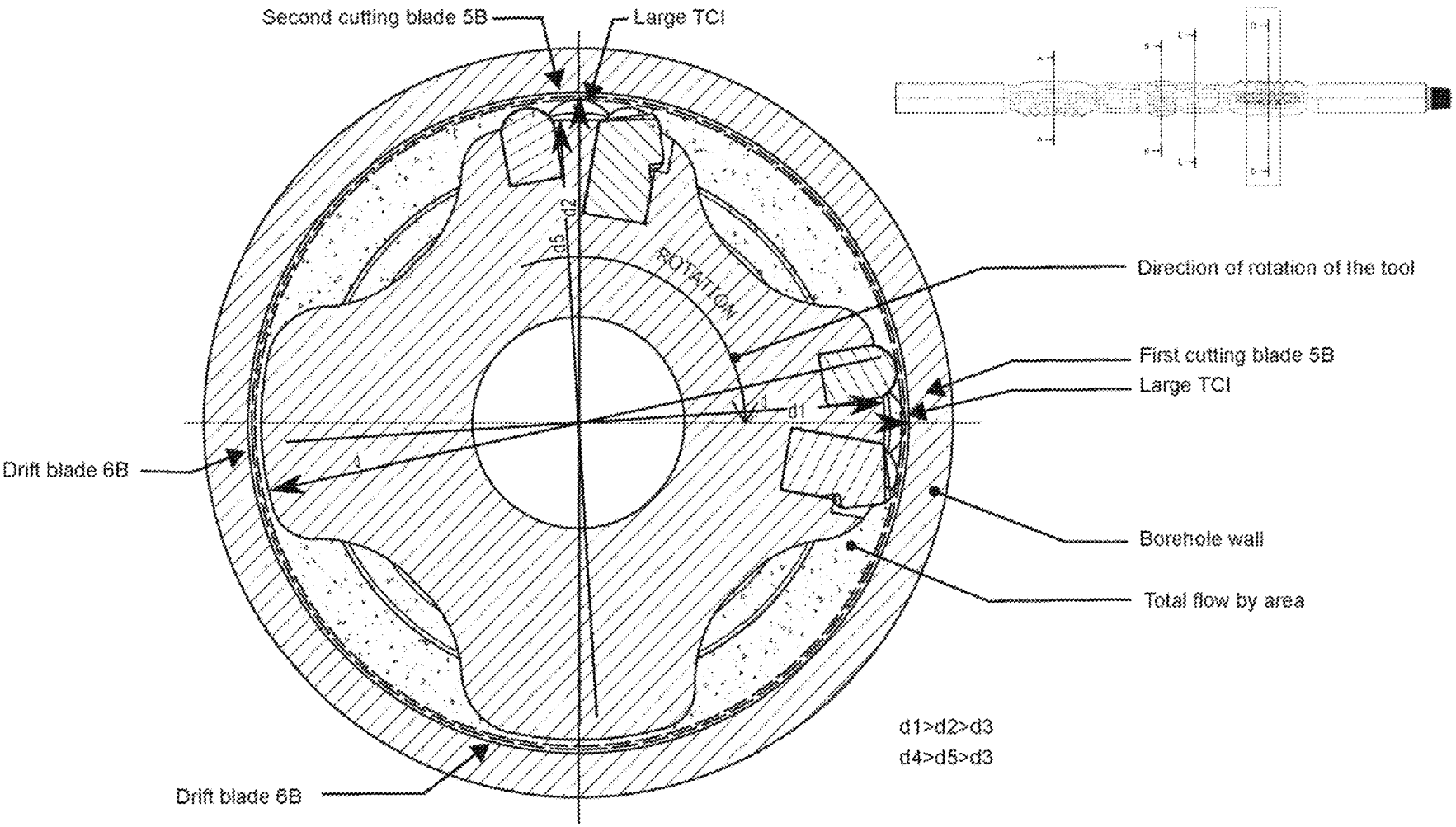

The trailing eccentric reamer stage 3A is positioned between the trailing section 2A and the drill cuttings agitator 4 along the longitudinal axis X of the tubular body as shown in FIG. 1 and has a cross-section as depicted in FIG. 1A. The trailing eccentric reamer stage 3A comprises one set of two straight cutting blades 5A, also referred to as "first set of straight cutting blades" and one set of two straight drift blades 6A, also referred to as "first set of straight drift blades". The set of two straight cutting blades 5A comprises a first cutting blade and a second cutting blade in the direction of rotation. The leading eccentric reamer stage 3B is positioned between the leading section 2B and the drill cuttings agitator 4 along the longitudinal axis X of the tubular body as shown in FIG. 1 and has a cross-section as depicted in FIG. 1 D. The leading eccentric reamer stage 3B also comprises one set of two straight cutting blades 5B, also referred to as "second set of straight cutting blades" and one set of two straight drift blades 6B, also referred to as "second set of straight drift blades". The set of two straight cutting blades 5B comprises a first cutting blade and a second cutting blade in the direction of rotation. The cutting and the drift blade sets 5A, 6A of the trailing eccentric reamer stage, and the cutting and the drift blade sets 5B, 6B of the leading eccentric reamer stage are angularly displaced about the longitudinal axis "X" by 180 degrees from each other, such that the cutting blade set 5A and cutting blade set 5B face opposite radial directions from the axis "X". Each set of two drift blades is positioned at 180 degrees circumferentially in respect of the set of two cutting blades. The cutting blades and drift blades can have a different shape.

The first cutting blade of the trailing and leading eccentric reamer stages extends radially outwardly from the outer surface of the tubular body and defines with its outermost surface an ideal cylinder having a diameter d4. The second cutting blade of the trailing and leading eccentric reamer stages extends radially outwardly from the outer surface of the tubular body and defines with its outermost surface an ideal cylinder having a diameter d5, where d5 is smaller than d4 (d5<d4). The drift blades 6A, 6B extend radially outwardly from the outer surface of the tubular body and define with their outermost surface an ideal cylinder having a diameter d3, referred to as drift diameter, or plastering diameter, where d3 is smaller than d5 (d3<d5).

The cutting and the drift blades of the trailing and leading eccentric reamer stages are designed to perform one of the following actions: i) cutting of the wellbore; ii) conditioning of the wellbore, i.e. improving of the geometric condition of the wellbore by removing any imperfections or rough areas of the borehole; iii) providing a plastering effect which is generated in the form of the drilled solids and bridging materials plastered against the borehole and packed into the filter cake, providing this way a better filter cake quality and improving the borehole strength.

Figure 2:
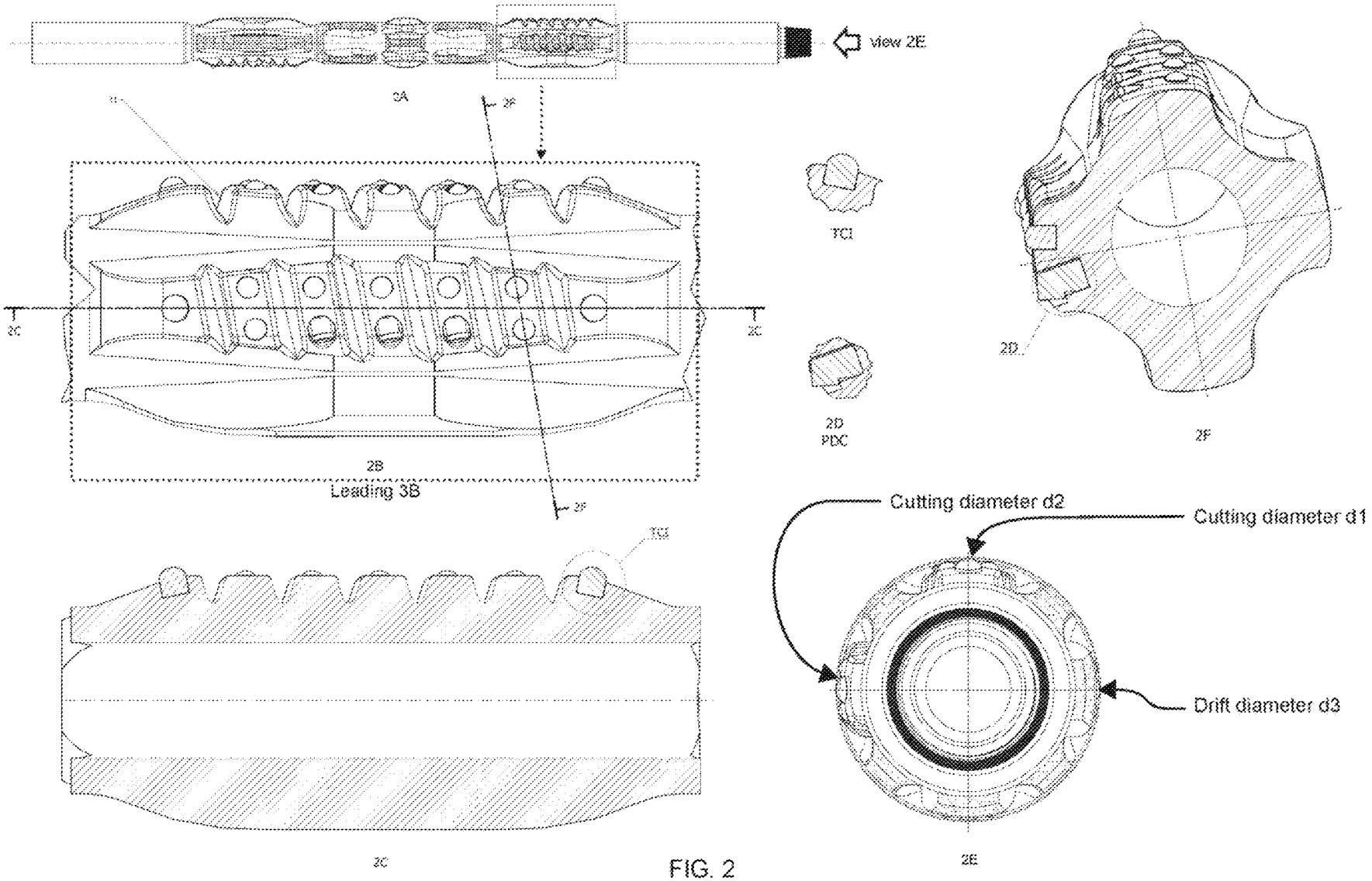
FIGS. 2A-2F depict details of the cutting and drift blades of the eccentric reamer stage according to the claimed invention.

Each cutting blade 5A, 5B of the trailing and leading eccentric reamer stages is straight and parallel to the longitudinal axis X of the tubular body. Each cutting blade 5A, 5B has on its surface deep helical grooves, said helical grooves running up the cutting blade defining in such a way a plurality of crowns 31 (see FIG. 2), where said helical grooves run in the direction of rotation of the tool. On the top surface of each of said crowns there is arranged one or a plurality of cutting elements (PDC, TCI) that are facing the path of rotational movement relative to the well bore.

The plurality of cutting elements, also referred to herein as "cutting structure", i.e., polycrystalline diamond compact (PDC) cutter inserts and/or tungsten carbide inserts (TCI), are disposed on each of the cutting blades and are arranged in straight longitudinal rows. Each cutting element (PDC or TCI) has a predetermined height (h) measured from the outer surface of the cutting blade. The PDC cutting inserts are referred to as active cutting elements, in the sense that they actively cut and do not simply rub the wall of the borehole, whereas the TCI inserts are referred to as passive cutting elements. The set of cutting blades of the leading eccentric reamer stage does most of the borehole enlarging also referred to as reaming, the set of the cutting blades of the trailing eccentric reamer stage does conditioning of the borehole and the set of drift blades are stabilizing blades positioned circumferentially at 180° from the first cutting blades at the drift side of the tubular body, and act to dynamically stabilize the tool during rotational reaming, and in this way minimizing the vibrations of the tool and also provide plastering effect.

The cutting elements inserted in the first cutting blade of the trailing and leading eccentric reamer stages define with their outermost surface an ideal cylinder having a diameter d1, where d1 is greater than d4 (d1>d4). The cutting elements inserted in the second cutting blade of the trailing and leading eccentric reamer stages define with their outermost surface an ideal cylinder having a diameter d2, where d2 is smaller than d1 (d2<d1), d2 is greater than d3 (d2>d3), and d2 is greater than d5 (d2>d5).

The first cutting blade in the rotational direction of the leading eccentric reamer stage 3B has on top of its surface a combination of PDC and TCI inserts, and does the initial cutting action of the borehole, shown in FIG. 1 D. Said first cutting blade is followed, see the curved arrow in FIG. 1 D, by the second cutting blade in the rotational direction and performs a conditioning of the borehole, i.e., improving of the geometric condition of the borehole by removing any imperfection or rough areas of the borehole walls. This second cutting blade of the leading eccentric reamer stage 3B also has on its surface a combination of PDC and TCI, and provides a passive cutting effect and reduces the vibration induced by repetitive activities and allows drilling without damaging costly casing.

Finally, the drift blades of the leading eccentric reamer stage 3B (FIG. 1 D) that follow the second cutting blade in the rotational direction, provide a mud plastering effect on the walls of the borehole that strengthens the wellbore, by creating a smooth and impermeable type layer i.e., low permeability filter cake on the circumference of the wellbore.

The cutting blades of the trailing eccentric reamer stage 3A have only TCI inserts on top of their surface, and therefore the first and the second cutting blades of the trailing eccentric reamer stage 3A perform only conditioning of the borehole.

The aggressiveness of the PDC elements can be adjusted by altering two-dimensional parameters prior to tool manufacture, namely by altering the back rake angle and the maximum gauge radius from the tool's longitudinal cutting diameter axis. The following limits shall be applied when finalizing the back rake angle for the PDC elements: soft formation: 18-21°; medium-hard formation: 15-18°; and hard formation: 13-15°, and a side rake angle of 0°.

The PDC cutter type and geometry can be adjusted to ensure that the reamer can be optimally dressed for the formation being drilled and for the specific drilling application.

Between the cutting blades of the leading and trailing eccentric reamer stages there are flow-by pass channels defined by the outer surface of the tubular body and the longitudinal walls of two consecutive blades. The bottoms of the helical grooves stand proud of the surface of the flow-by pass channels between the cutting blades.

The deep helical grooves between the crowns of the cutting blades are designed to allow the removed cuttings to be pushed out into the oncoming mudflow between the blades of the tool. The helical grooves also increase the flexibility of the blade while cutting. The cutting structure cuts into the doglegs, and cuttings are pulled up the groove by the rotation of the tool and into the longitudinal flow by-pass channel also referred herein as "flow-by channel" formed between the blades (see FIG. 3).

When the tool is in operational mode (i.e., in use), two degrees of freedom provide the cutting motion: axial movement down the wellbore, and rotational movement. Using this and the optimized positioning of the PDC/TCI cutters on the blades, the positioning of the helical groove between the crowns produces a better finish by redirecting and/or redistributing the cutting forces and stresses, not necessarily reducing them.

The cutting blades sets of the leading and trailing eccentric reamer stages are angularly displaced about the longitudinal tool axis by 180°, circumferentially opposing these in each blade set are dual drift blades which are hard branded and are positioned to dynamically stabilize the cutting structure whilst reaming. This off-set arrangement of the cutting blades will marginally enlarge the wellbore diameter and ensure that the bit will be able to pass through the wellbore without the need for back reaming. Due to this arrangement, the two sets of cutting structures are angularly placed on the cutting blades by approximately 180 degrees on the drill string.

It is essential that the tool maintains a stable cutting behavior and remains centered on the drill center axis of the wellbore being drilled, despite having a significant mass above and/or below its positioning in the bottom hole assembly. This is achieved by having a set of drift blades positioned 180 degrees circumferentially to the set of cutting blades. The drift blades are designed to dynamically stabilize the cutting action by helping the cutting blades remain centered on the drill center axis during rotation.

Figure 4:
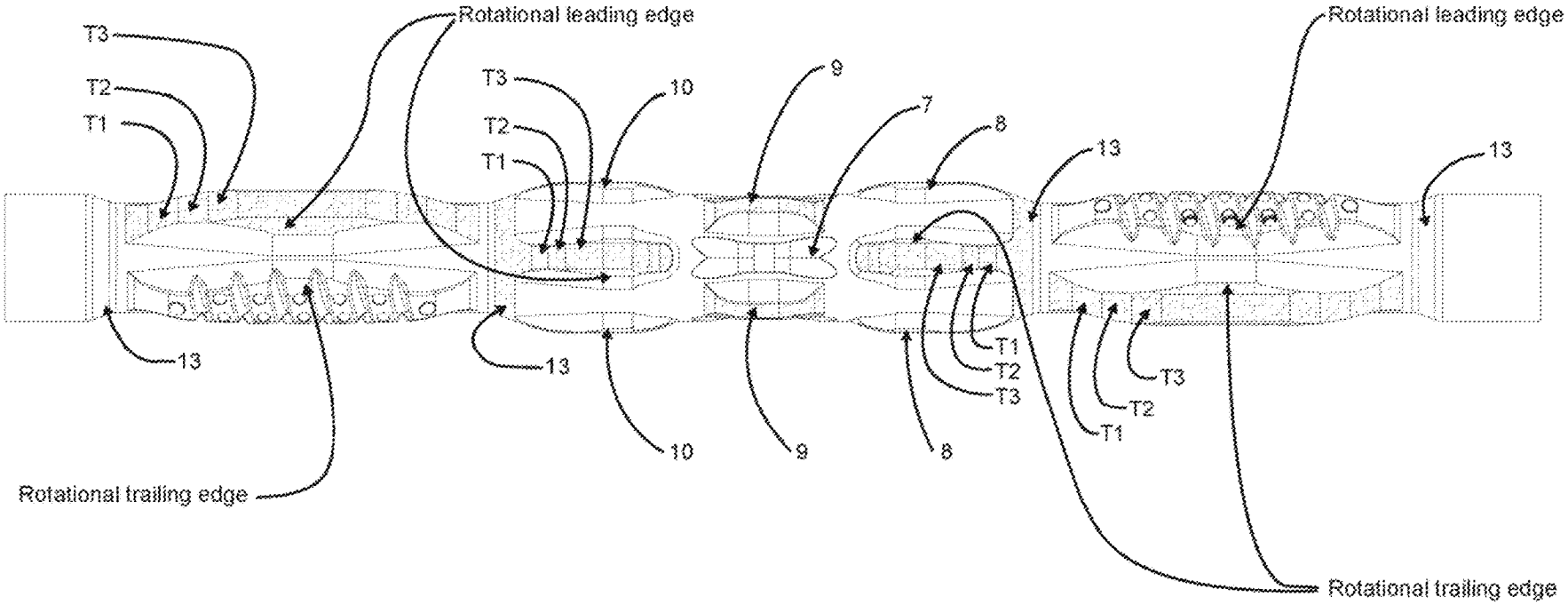
FIG. 4 depicts the leading and the trailing reamer stages, and the drill cuttings agitator according to the claimed invention, further showing the rotational leading and trailing edges of the blades, and angled faces of the drift blades at the toe and heel, and the 3-stage tapers of the blades.

Each drift blade 6A, 6B of the trailing and leading eccentric reamer stages is straight and parallel to the longitudinal axis X of the tubular body. Each drift blade 6A, 6B has a dome shaped surface, that defines the surface contact area with the wellbore, and extends radially outwardly from the outer surface of the tubular body 2. The set of straight drift blades of the leading eccentric reamer stage are positioned circumferentially 180 degrees from the set of drift blades on the trailing eccentric reamer stage, and both sets of drift blades function as stabilizing blades. The center of the circle on which said drift blades are positioned is offset by a predetermined distance by the center of the tubular body part. Said drift blades are shaped wide in the middle and tapering towards the ends, but not to a point. To minimize or eliminate overpull required to trip out of the wellbore, hangup and overcome the static friction on the body, the first and second stabilizing blades 8, 10, the cutting blades 5A, 5B and the drift blades 6A, 6B are formed with unique 3-stage toe and heel angles which ensures a gradual cutting action and minimizing torque and vibration. The drift blades have angled faces at the toe and heel designated as a first angled face "T1", a second angled face "T2", and a third angled face "T3" as shown in FIG. 4. Angled faces T1, T2 and T3 have different angles measured from the surface of the tubular body in the longitudinal direction X, in particular the angle of the first angled face T1 is greater than the one of the second angled face T2, and the angle of the second angled face T2 is greater than the one of the third angled face T3. These unique toe and heel angles of the drift blades help reduce friction and enhance the tool's performance while sliding in oriented mode i.e., a mode with no rotation of the drill string above the bit while drilling a curved path.

Figure 8:
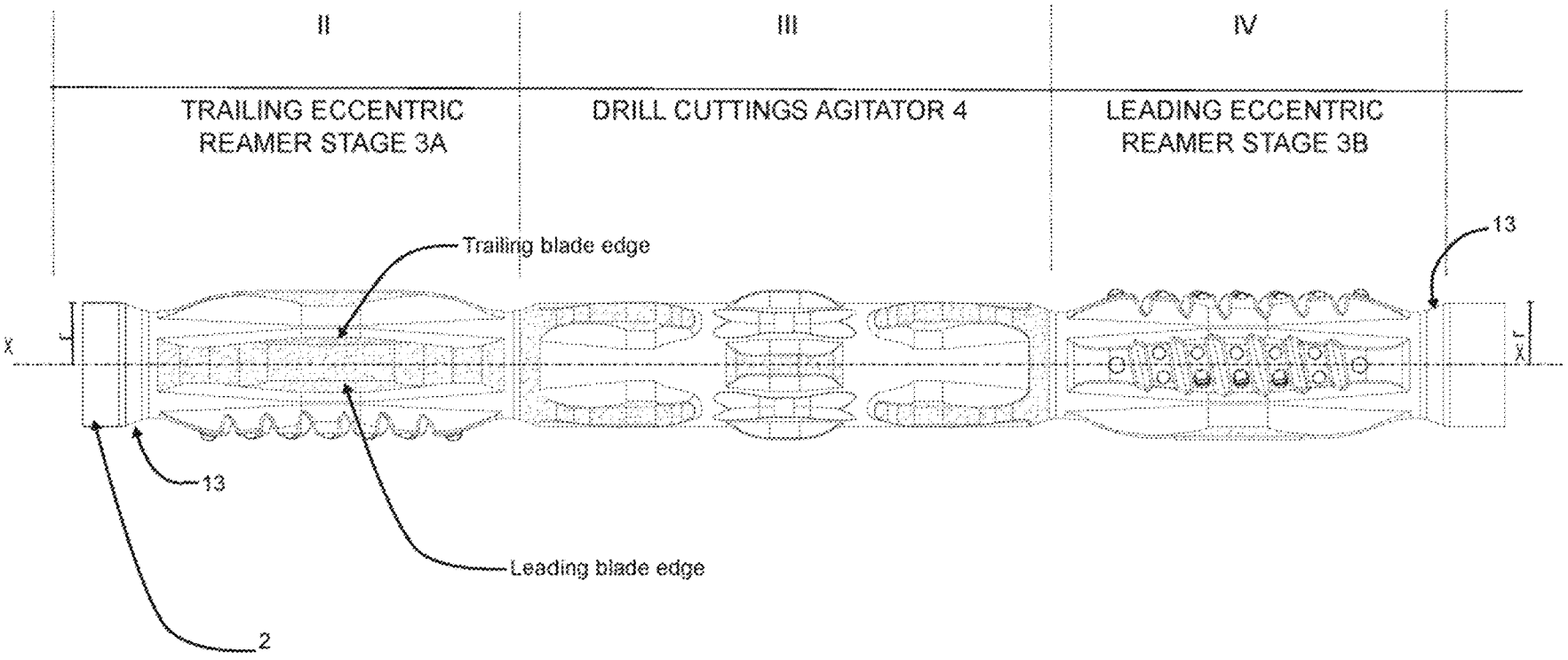
FIG. 8 depicts a front view of the wellbore conditioning system, further showing the trailing and leading blade edges of the drift blade according to the claimed invention.

Each drift blade has a leading and a trailing edge, both having different radii of curvature. The leading edge and trailing edge are shown in FIGS. 4 and 8. The leading edge has a more filleted/smooth transition, which helps condition/plaster the wellbore and prevents any cutting effect on the wellbore. The surface area of the rotational trailing edge of each drift blade is smaller than the surface area of the rotational leading edge so the contact area of the drift blade with the wellbore is maximized. This trailing edge also has a conditioning effect on the wellbore, but to a much lesser extent than the leading edge. Having as much contact with the wellbore as possible at this region between the leading edge and trailing edge ensures stabilization of the cutting blades that are positioned along a circumference coaxial with the tubular body at a distance of 180 degrees from the drift blades.

The wellbore contact geometry and contact area of the drift blades 6A, 6B are different to that of the cutting blades, which helps minimize friction with the formations, dampens oscillations.

During drilling the flow rate of the drilling fluid over a cross-section of the wellbore is not uniform; nearer to the low side, the flowrate is at a minimum and as a result, reduces the capacity of the drilling fluid to move the cuttings effectively. This problem can be overcome with the drill cuttings agitator having a plurality of stabilizing blades 8, 9, 10 and hydrodynamic flutes 7 in accordance with the present invention.

Figure 3:
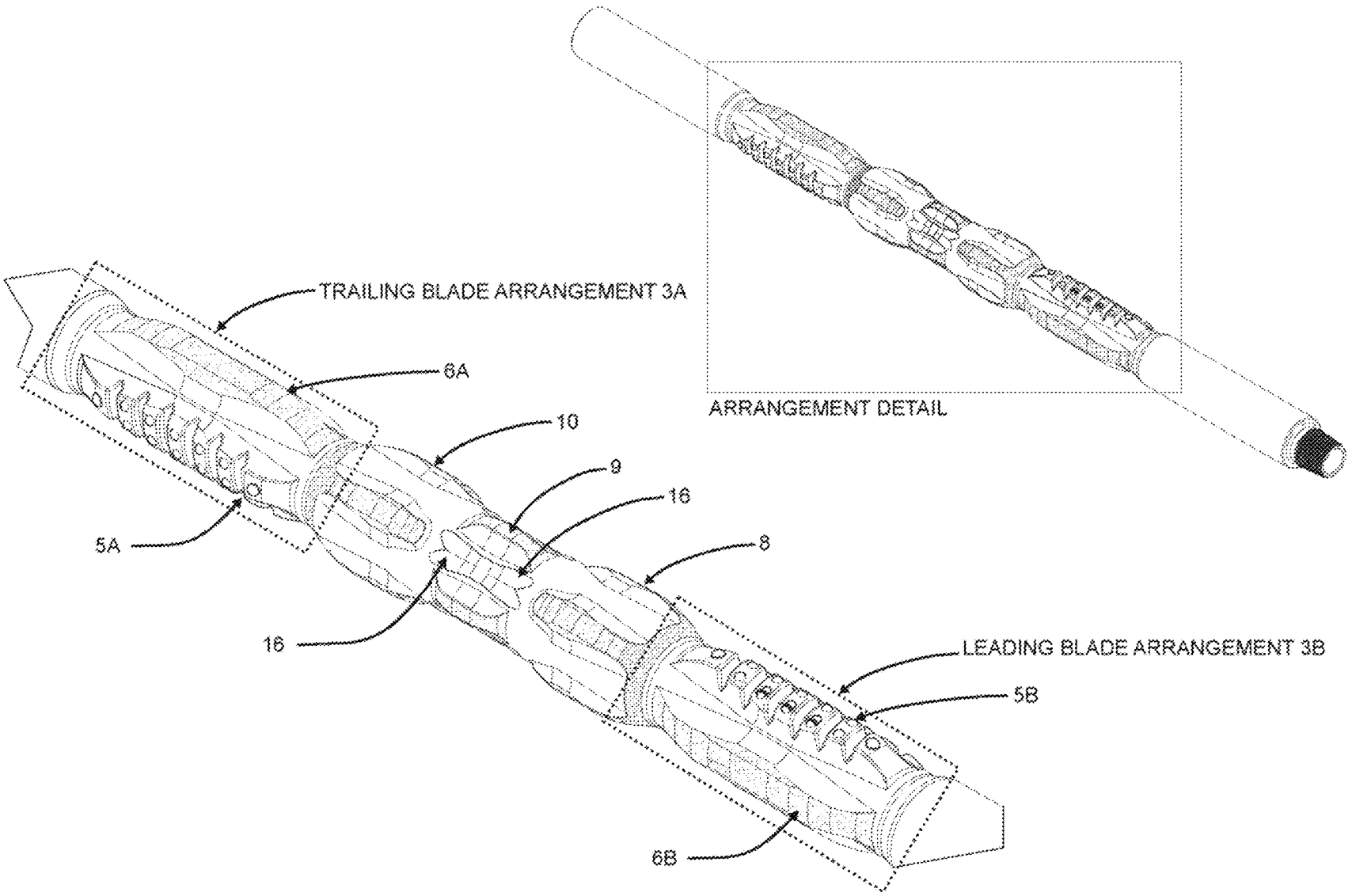
FIG. 3 is an enlarged view of the leading and the trailing reamer arrangement according to the claimed invention.

FIGS. 3-4 depict the mid tool feature detail, namely the drilling cuttings agitator positioned between the two eccentric reamer stages 3A, 3B. FIG. 4 illustrates the drilling cuttings agitator, that corresponds to section III of the tubular body.

The drill cuttings agitator 4 that is positioned between the trailing and the leading eccentric reamer stages, comprises a plurality of stabilizing blades 8, 9, 10 and a plurality of hydrodynamic flutes 7, said hydrodynamic flutes being located circumferentially between the center stabilizing blades 9.

Said stabilizing blades 8, 9, and 10 have a curved surface along on the longitudinal axis "X" of the tool and are straight and parallel to the longitudinal axis X of the tubular body. These stabilizing blades 8, 9, 10 are formed e.g., milled, machined, as an integral component of the body of the drill cuttings agitator 4 and positioned between the leading eccentric reamer stage 3B and the trailing eccentric reamer stage 3A of the wellbore conditioning system. Each stabilizing blade's outer radial face shall be covered 100% by a replaceable wear element, e.g., hard facing.

The plurality of stabilizing blades 8, 9, 10, are defined as: a plurality of first stabilizing blades 8, also referred to as first stabilizing blades 8; a plurality of center stabilizing blades 9, also referred to as center stabilizing blades 9; a plurality of second stabilizing blades 10, also referred to as second stabilizing blades 10. Each stabilizing blade of said plurality of first, second and center stabilizing blades has an elongated shape parallel to the longitudinal axis X of the tubular body 2. Said plurality of stabilizing blades 8, 9, 10 form three groups: a first group comprising the first stabilizing blades 8, a second group comprising the second stabilizing blades 10; a center group comprising the center stabilizing blades 9, where each group of said three groups has four stabilizing blades.

Said three groups of stabilizing blades are disposed on the surface of the tubular body at a predetermined interval parallel to the longitudinal axis X. Said plurality of stabilizing blades extend outwardly from the outer surface of the tubular body, and with their most outwardly radially extended surface define an ideal cylinder that is coaxial with sections III of the tubular body. The first group of stabilizing blades 8 is positioned at one end of the drill cutting agitator immediately after the plurality of leading cutting blades 5B of the leading eccentric reamer stage 3B. The second group of stabilizing blades 10, similar to the first group is positioned at the other end of the drill cutting agitator, immediately before the plurality of trailing cutting blades 5A of the trailing eccentric reamer stage 3A. Between these two groups of stabilizing blades 8, 10, there is the group of center stabilizing blades 9. Each stabilizing blade of the described groups is disposed at a predetermined interval i.e., 90 degrees apart from each other, along a circumference coaxial with the tubular body.

A hydrodynamic flute 7 is disposed between each two consecutive center stabilizing blades 9. Also, a flow by-pass channel is defined between each two consecutive first and second groups of stabilizing blades 8, 10.

Furthermore, the group of center stabilizing blades 9 is offset by 45 degrees from the preceding first stabilizing blades 8 and the following group of second stabilizing blades 10.

Each stabilizing blade of the drill cutting agitator 4 is straight and is aligned along the longitudinal X axis. Each stabilizing blade of the drill cutting agitator 4 has an elongated shape, a front section, a back section, and a central section, and an upper surface having the shape of a dome defining the contact area, and side walls. The back section of the stabilizing blades 8, 10 belonging to the first and second groups tapers from said central section towards a back end. The front section of the stabilizing blades belonging to the first and second groups tapers towards a front end that has substantially the shape of a semicircle, said front section being substantially greater than the average width of the back section. The upper surface of the stabilizing blades 8, 10 belonging to the first and second groups slopes downwards near and towards the end of the front section and also near and towards the end of the back section till it meets the surface of said cylindrical body part forming this way a toe and heel having a unique 3-stage angled faces with different angles measured from the surface of the tubular body in the longitudinal direction X, namely a first angled face T1, a second angled face T2, and a third angled face T3, where the angle of the first angled face T1 is greater than the one of the second angled face T2, and the angle of the second angled face T2 is greater than the one of the third angled face T3, as shown in FIG. 4. Each of the first, second and center stabilizing blades has in the rotational direction, a leading and a trailing edge, where said leading and trailing edges have different radii of curvature. The stabilizing blades 8, 10 belonging to the first and second groups are essentially the same, whereas the stabilizing blades 9 belonging to the center group have a different shape and smaller dimensions.

Each blade of the first group of stabilizing blades 8 has a shape that is wide in the middle and tapers downstream towards a back end that is straight the cutting blade 5B and in the upstream direction tapers to a substantially semicircular back end towards the center stabilizing blades 9. As the flow of drilling fluid exits the leading eccentric reamer stage 3B, that corresponds to section IV of the tubular body 2 of FIG. 1, said flow meets section III that corresponds to the drill cuttings agitator, said section III has an increased diameter in respect of section IV of the tubular body 2. This configuration directs the fluid flow towards the borehole wall, at the same time said flow passes between the flow by-pass channels between the first group of stabilizing blades 8. The combined dual action of the increase in the diameter of section III and the narrowing of the flow-by pass channels, increases the mud velocity. The positioning of the first group of stabilizing blades 8, where said blades 8 taper towards the leading eccentric reamer stage 3B, tends to induce an agitator effect on the low side of the wellbore where the cuttings beds are located. The positioning and geometry of the stabilizing blades 8, 9 and 10 of the drill cuttings agitator is such that they efficiently displace the drilling fluid around the tool and between eccentric reamer stages 3A and 3B whilst effectively agitating the lodged cuttings on the low side while the tool travels along the borehole trajectory, thus their interaction has a synergistic effect.

Said stabilizing blades 8, 9, 10 increase the velocity of the cuttings from the leading eccentric reamer stage 3B to the trailing eccentric reamer stage 3A, alter the direction of the drilling mud along the exterior of the tool and stabilize the tool in the borehole. As the tool rotates, it works two-fold: initially, by increasing the flow of the cuttings from the cutting blade structure over the section III length of the tool, secondly the stabilizing blades disturb the settled cuttings and move them up into the flow path of the drilling mud in the upper side of the wellbore this way providing an improved cuttings transportation and hole cleaning. At the low side of a horizontal wellbore the pressure and turbulence created by these stabilizing blades is directed at the segmented concentration of cuttings, and as the tool rotates this creates a scouring effect in the cuttings bed. Thus, the drill cuttings agitator accelerates the drilling fluid and cuttings over the length of the tool, and it picks-up/agitates cuttings bed accumulation on the low side of the horizontal wellbores.

Further, the agitator's stabilizing blades 8, 9, 10 stabilize the tool in the BHA. The wellbore conditioning system, thus, enhances the cutting transportation by having hydrodynamically positioned stabilizing blades 8, 9, 10 designed to stir a low side cuttings bed in horizontal well sections. As the reamer translates in a counter rotation downhole, and as drilling fluid and suspended cuttings and cavings flow past the stabilizing blades of the drill cuttings agitator located between the trailing and the leading eccentric reamer stage blade sets i.e., the cutting and the drift blades 5A, 5B, 6A, 6B, the geometry of the stabilizing blade elements increases the velocity of the drilling fluid, thus creating a turbulence in the mid-tool annulus, and producing a cleaning effect on the wellbore wall due to bearing pressure against the wall of the wellbore.

More in detail, a filter cake (or mud cake) is formed when the insoluble solid portion of the drilling fluid becomes deposited on a permeable material i.e, formation or porous rocks, as the drilling fluid makes contact with that material under pressure, so that permeation of the native formation is reduced or eliminated, and the wellbore fluids are isolated from the insoluble solid portion of the drilling fluids that occupy pore spaces in the formation at the wellbore wall. This is important in terms of wellbore stability and to prevent differential sticking. According to the present invention, a good filter cake is achieved by the additional bearing pressure against the wall of the wellbore and by the increase in annular velocity of the drilling fluid combined with geometry of the stabilizing blades 8, 9, and 10 which leads to a more compact and steadier filter cake whilst minimizing the risk of pack off during drilling operations.

All elements of the drill cuttings agitator work in synergy as the tool translates in a counter rotation, agitating the cuttings beds on the lower side of the wellbore up into the circulating drilling fluid where they are transported upstream. This way improving the hole cleaning, which is achieved through more effective transportation of cuttings across the tool thusly eliminating the need for dedicated wiper trips.

FIG. 2B shows one of the eccentric reamer stages 3B having a set of cutting blades 5B, said cutting blades having a dome shaped surface extending radially outwardly from the outer surface of the tubular body 2. Said cutting blades have a back end and a front end and are shaped wide in the middle and tapering towards the ends, but not to a point. Each cutting blade has a leading and a trailing edge, both having different radii of curvature.

Drilling of the well occurs as the tool rotates counterclockwise. It is possible to have the cutting and drift diameter offset from the drill center by a fraction of an inch.

All blades of the leading eccentric reamer stage, all blades of the drill cuttings agitator and all blades of the trailing eccentric reamer stage are offset at 45 degrees in respect of the preceding or the following blades along the longitudinal axis X of the tubular body forming this way oblique flow-by channels in respect to the longitudinal axis X of the tubular body.

Oblique channels of 45 degrees in respect to the longitudinal axis X of the tubular body are formed between the back end of the leading cutting blade set 5B and front section of the first stabilizing blades 8 of each neighboring pair of blades to allow the flow of drilling fluid and cuttings during operations, this way defining the flow-by area between the blades.

The Total Flow by Area (TFA) i.e., the total volumetric flow (opening) between the exterior surface of the eccentric reamer stage and the circumference of the wellbore, is reduced at the blades locations, and to maintain adequate contact points with the wellbore and optimum flow rates it's important to ensure there is a percentile balance. To provide an effective hole cleaning on a Hole Size up to an outside diameter of 10-⅝", the recommended Total Flow by Area should be >25% of the hole size. Hole Sizes of a greater diameter than 10-⅝", should have a Total Flow by Area of >35% of the hole size.

In hole sizes of 8½" (inches), the total flow area (TFA) ratio between tool outside diameter in smaller hole sizes is a quite different and parasitic pressure drop in the annulus can be significant in certain formations. The incorporated recessed flow-by pass channels, therefore, partially compensates for the annular area occupied by the blades. This, combined with optimized hydrodynamics, e.g., blades that are wide in the middle and tapering towards the ends but not to a point, facilitates increased transportation of cuttings around the blades 5A, 5B, 6A, 6B.

The front and back sections of the center stabilizing blades 9 of the drill cuttings agitator are substantially smaller than the central section of said center stabilizing blades 9. The reason behind this is to channel the mud flow from the first stabilizing blades 8 to the second stabilizing blades 10. The positioning of the first stabilizing blades 8 is such that they can efficiently displace the drilling fluid and cuttings around the blades of the wellbore conditioning system and increase the velocity of fluid exiting the leading reamer stage 3B, this increase in velocity combined with the stirring action created by the rotational side wall also known as the leading edge of the first stabilizing blade 8, stirs cuttings from the low side up to the high side of the wellbore.

The shape of the stabilizing blades 8, 9, 10 of the drill cuttings agitator is such that they effectively generate a venturi effect, which efficiently displaces the drilling mud or drilling fluid and suspended cuttings as it exits the cutting blade structures 5B and then enters around the first stabilizing blades 8. The stabilizing blades and the cutting blades are placed in such a way along the cylindrical surface of the tubular body in order to agitate any cuttings. This mechanical dual-acting blade placement removes cuttings beds inside the casing or in an open hole. The flow-by pass channels formed e.g. milled into the outer surface of the tubular body between the cutting blades 5A and 5B, are designed to create a self-cleaning and jetting-effect, accelerating the transportation of the cuttings dislodged during reaming over the center of the tool.

When drilling horizontal wellbore sections, the higher density of cuttings in the low side of the wellbore causes increased drag on the drill string when sliding through the cuttings beds. The first, second and center stabilizer blades 8, 9 and 10 are designed to stir up the cuttings beds into the fluid with a lower density on the high side of the wellbore, and then transport them over the tool and upstream for processing, and also to stabilize the tool in the borehole.

Located between the center stabilizing blades 9, there are a plurality of hydrodynamic flutes 7. Said hydrodynamic flutes are formed e.g., milled as an integral component of section III of the tubular body and said flutes extend radially inwardly from the outer surface of said tubular body. Further, the hydrodynamic flutes are designed to create a self-cleaning action by maintaining and further increasing the velocity of the drilling fluid along the tubular body. The hydrodynamic flutes 7 help support and further enhance the advantageous flow pattern created by the drilling cuttings agitator formed between leading reamer stage 3B and first stabilizing blade 8.

Further, the hydrodynamic flutes 7 are aligned with the X-axis of the section III of the tubular body and are parallel to one another. The flutes are elongated indents in the outer surface of the tubular body, having a longitudinal axis running from a downstream end to an upstream end that is parallel to the X-axis of the cylindrical body. The flutes are shaped advantageously, with two mirrored diverging indented paths 16 (see FIG. 3) at the downhole end and at the uphole end, with an ellipse shaped channel between and connecting said diverging indented paths 16.

The term "uphole" refers to the direction along the longitudinal axis of the wellbore that leads back to the surface, and the term "downhole" refers to equipment or processes that are used inside the well, more specifically in terms of direction refers to the direction toward the bottom-hole assembly.

The number of hydrodynamic flutes 7 located on the perfect circle may be four but may be depending on the diameter of the tool, and the number of the center stabilizing blades 9 formed, e.g., milled, in the tubular body. The diverging paths at each end of the flutes are designed to create as such at the downhole end of the hydrodynamic flutes 7 an inlet for the drilling fluid entering from between first stabilizing blades 8 and center stabilizing blades 9, respectively and an outlet for the drilling fluid at the uphole end.

Additionally, the advantageous positioning of the four or more center stabilizing blades 9 and four or more first stabilizing blades 8 and four or more second stabilizing blades 10, optimizes the stabilization of the tool and hydrodynamics of the cuttings bed agitator function. The flow acceleration over the center section of the drill cuttings agitator 4 may not cause or contribute to the borehole wall's penetration, which can lead to borehole instability and ultimate sectional collapse. The center section of the agitator shall provide stability when weight is applied, or when buffering occurs from vibration and shock loads being transmitted through the drill string. Furthermore, the specific configuration of the agitator's stabilizing blade set 8, 9,10 including the specific assortment and shape of the stabilizer blades and hydrodynamic flutes 7 arranged between them, creates a selfcleaning action, i.e., venturi effect, which has shown to minimize mud build-up, to provide homogeneous drilling fluid flow, and to minimize balling up.

The leading eccentric reamer stage 3B is placed at a minimum of distance apart from the trailing eccentric reamer stage 3A to provide the optimum cyclic cutting motion for the reaming functionality. The maximum radially outward extension of the external surface of the stabilizing blades 8, 9 and 10 is equal to or less than the maximum radially outward extension of the drift blades 6A and 6B. The radially outward extension of the drift blade 6A is equal to the radially outward extension of drift blade 6B.

The outer circumference of the drift blades 6B, 6A and stabilizing blades 8, 9, 10 makes contact with the wellbore and therefore is coated with a replaceable wear element, e.g., hard facing.

The plurality of stabilizing blades 8, 9, 10 increase the velocity of the cuttings from the leading to the trailing eccentric reamer stage and alter the direction of the drilling mud along the exterior of the tool. As the tool rotates, it works two-fold: initially, by increasing the speed of the flow of the cuttings from the cutting blade structure over the mid-section length of the tool, and secondly, the blades disturb the settled cuttings and moves them up into the flow path of the mud in the upper side of the wellbore.

The drift blades 6A, 6B, the cutting blades 5A, 5B, and the agitator's stabilizing blades 8, 9, 10 have a leading and trailing rotational edge with respect to the rotation of the tool.

Figure 5:
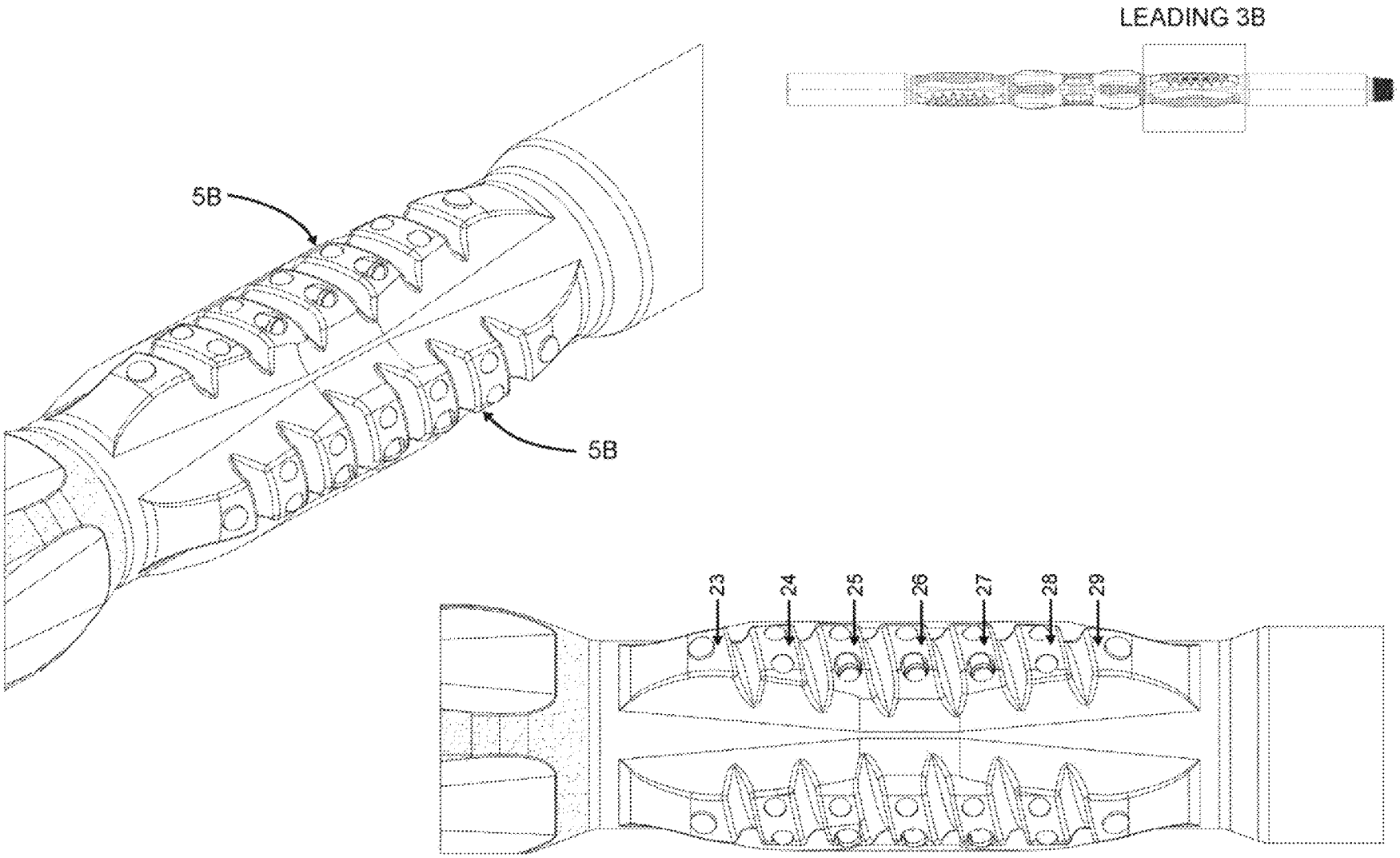
FIG. 5 depicts the eccentric leading reamer stage blade set detail according to the claimed invention.

In a preferred embodiment, each of the cutting blades 5B of the leading eccentric reamer stage 3B (shown in FIG. 5) has seven crowns 23, 24, 25, 26, 27, 28, 29. On top of each of the first crown 23 and last crown 29 there is one large dome shaped TCI insert, referred to as "large TCI". The rest of the TCIs, positioned on crowns 24, 25, 26, 27, 28, are referred to as "smaller TCIs". These two large TCIs of the crowns 23,29, being larger than the smaller TCI, are strategically positioned to prevent damage to the PDC elements and the smaller TCIs when the tool passes through the casing "steel tube" further up in the wellbore. The PDC cutters and the smaller TCIs (see crowns 25, 26, 27, FIG. 5) are arranged in two straight longitudinal rows, where the straight longitudinal rows are parallel to each other. One of the two straight longitudinal rows comprises three PDCs elements on top of the crowns 25, 26, 27 while the other row comprises three smaller TCIs. Each of the crowns 24, 28 comprises one or more smaller TCIs. Each of said two large TCIs is positioned on an ideal line passing in the middle between the two straight longitudinal rows of said PDCs and smaller TCIs. The large TCIs, the smaller TCIs and the PDCs inserts have different heights (h), where the height (hi) of the large TCIs is greater than the height (h2) of the smaller TCIs, and the height of the smaller TCIs is greater than the height (h3) of the PDCs, namely h1>h2>h3. The reason for this difference (h1>h2>h3) is that this way the large TCIs protect the smaller TCIs and the PDCs from being damaged as explained above, and similarly the smaller TCIs protect the PDCs.

The large TCI defines the diameter d1. There could be situations in which the use of the large TCIs is not necessary, then the diameter d1 is defined by the smaller TCIs.

Figure 6:
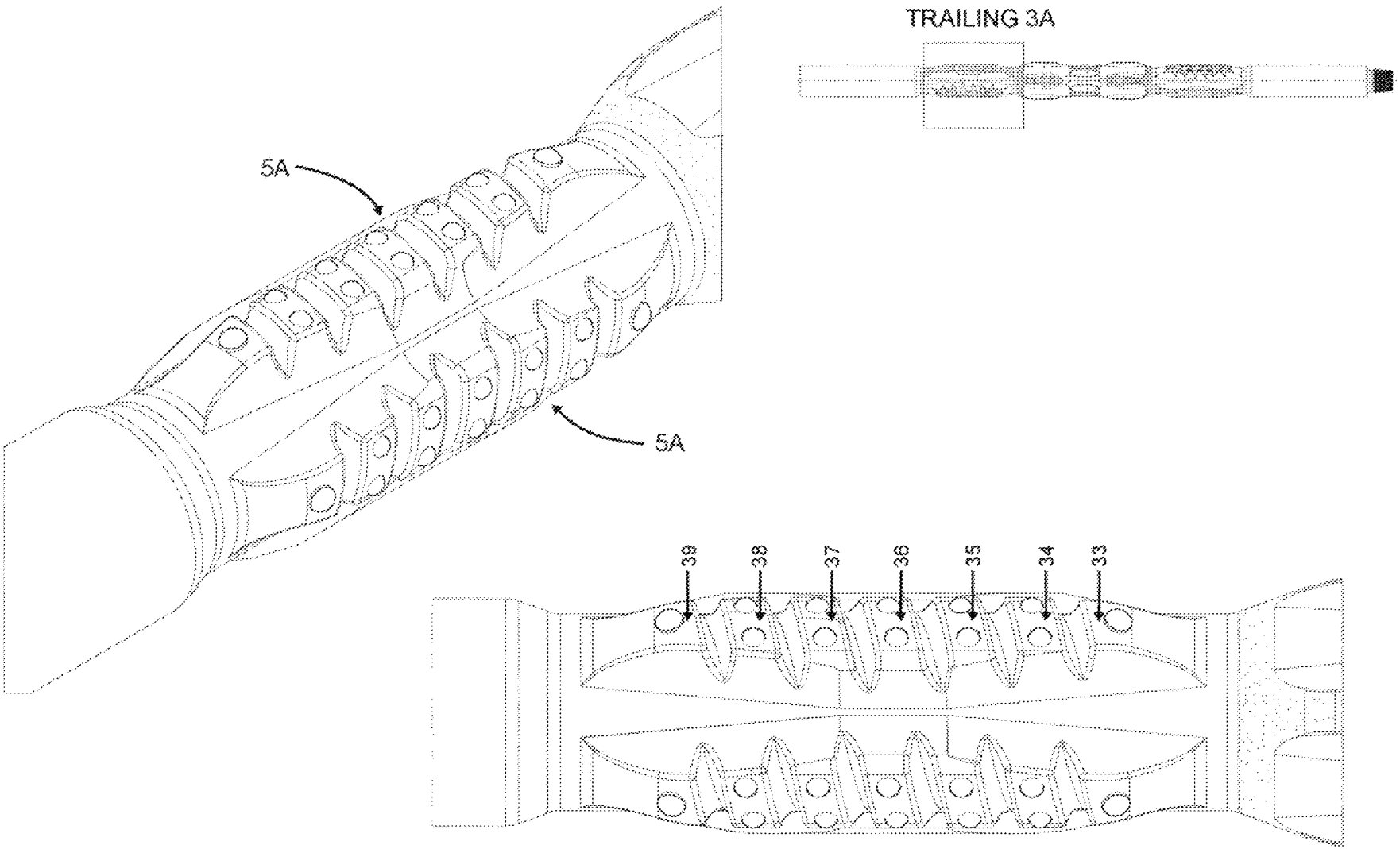
FIG. 6 depicts the eccentric trailing reamer stage blade set detail according to the claimed invention.
Figure 7:
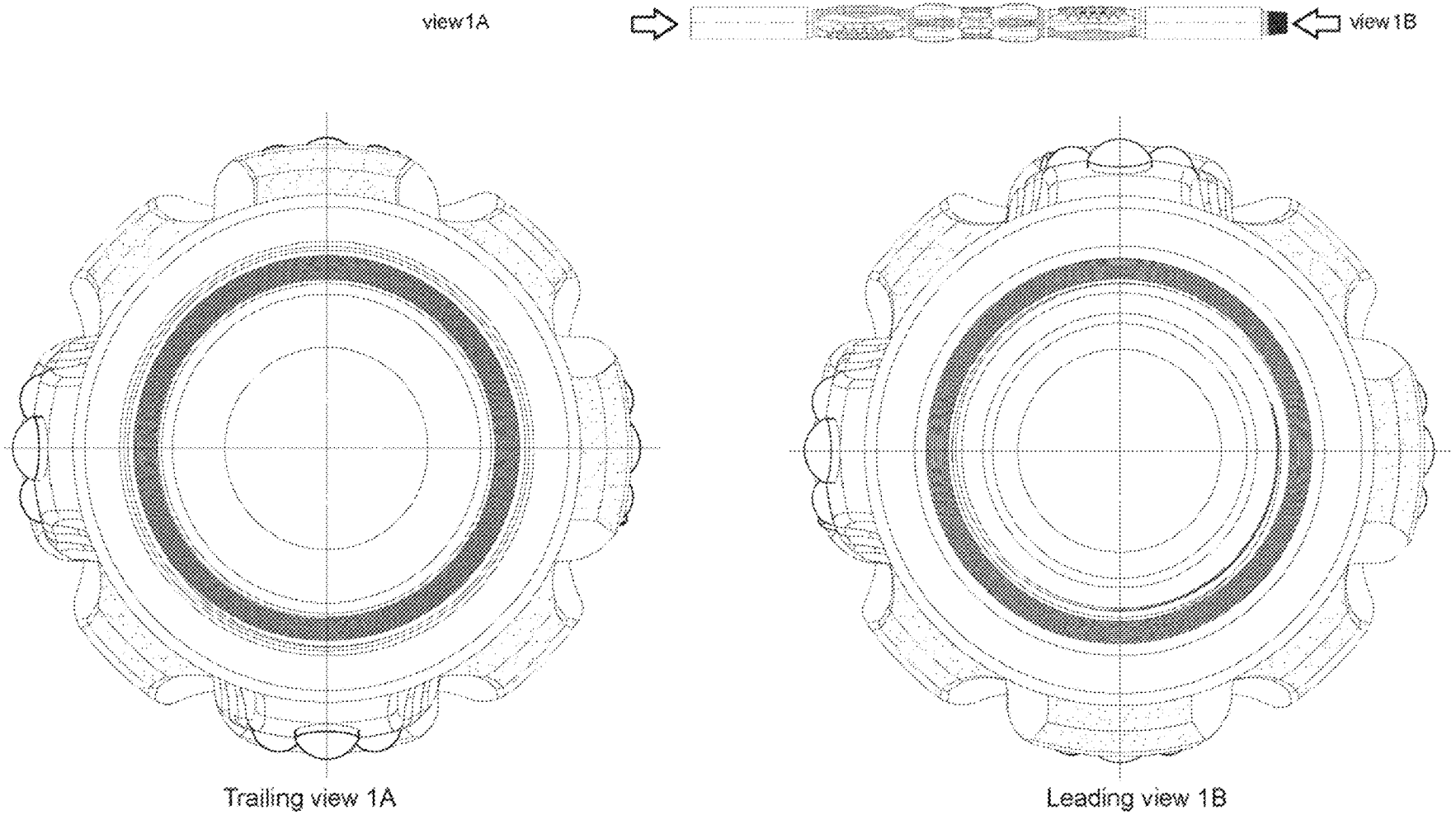
FIG. 7 depicts an end view of the trailing 1 A and leading 1 B eccentric reamer stages blade set details according to the claimed invention.

Each of the cutting blades 5A of the trailing eccentric reamer stage 3A (shown in FIG. 6) has seven crowns 33, 34, 35, 36, 37, 38, 39 comprising only TCIs, being large and smaller TCIs, said large and smaller TCIs being defined in the same way as the one of the leading eccentric reamer stages. One large TCI is positioned on each of the first crown 33 and last crown 39. The smaller TCIs are positioned on crowns 34, 35, 36, 37, 38. The smaller TCIs are arranged on top of the crowns 34, 35,36, 37, 38 in two straight longitudinal rows, where the straight longitudinal rows are parallel to each other. Each of said two large TCIs is positioned on an ideal line passing in the middle between the two straight longitudinal rows of smaller TCIs. The large TCIs and the smaller TCIs have different heights (h), where the height (hi) of the large TCIs is greater than the height (h2) of the smaller TCIs, namely hi>h2, so that the large TCIs prevent damage to the smaller TCIs when the tool passes through the casing "steel tube" further up in the wellbore. Each large TCI defines the diameter d1.

The two large TCI's on the first cutting blade of the leading and trailing eccentric reamer stages extend radially outward more than the two large TCI's on the second cutting blade of the leading and trailing eccentric reamer stages.

The PDC elements are limited to the leading cutting blade 5B only; this may enhance the stability during cutting by minimizing the risk of a cutter snagging on the formation and then causing the tool to twist around the cutter or a number of aligned cutters radial extremities. The trailing cutting blade 5A is dressed with TCI's, which are intended to steadily caress the formation, reaming off any imperfections remaining from the initial cutting action of the leading blade structure, this way performing conditioning of the wellbore.

For optimum performance, the wellbore conditioning system should be run in tension and let the natural cyclic motion of the bottom hole assembly utilize the cutting structures to sheer off the imperfections while rotating without compromising weight and energy transfer to the drill bit.

It is to be understood that the above description is intended to be illustrative, and not restrictive and that various changes in the design details may be made without departing from the concept layout as presented or affecting the advantageous positioning of the features.

The invention claimed is:

1. A one-piece construction multi-functional wellbore conditioning system having a tubular body extending along a longitudinal axis X, said system comprising:

a trailing eccentric reamer stage (3A), a leading eccentric reamer stage (3B), and a drill cuttings agitator (4) being positioned between said trailing and leading eccentric reamer stages, wherein said drill cuttings agitator (4) comprises:

a plurality of first stabilizing blades (8) extending radially outwardly from an outer surface of the tubular body, a plurality of second stabilizing blades (10) extending radially outwardly from the outer surface of the tubular body, a plurality of center stabilizing blades (9) extending radially outwardly from the outer surface of the tubular body and arranged axially between the plurality of first stabilizing blades (8) and the plurality of second stabilizing blades (10), and a plurality of hydrodynamic flutes (7) extending in a longitudinal direction and extending radially inwardly from the outer surface of the tubular body, where each stabilizing blade of the plurality of first, second and center stabilizing blades (8), (9), (10) is disposed along a circumference coaxial with the tubular body at 90 degrees apart from each other and where the plurality of center stabilizing blades (9) is offset by 45 degrees from the preceding plurality of first stabilizing blades (8) and the following plurality of second stabilizing blades (10), said flutes being positioned circumferentially between the center stabilizing blades (9).

2. The one-piece construction multi-functional wellbore conditioning system in accordance with claim 1, wherein the trailing eccentric reamer stage (3A) comprises a first set of straight cutting blades (SA) and a first set of straight drift blades (6A), said first set of straight drift blades (6A) being positioned along a circumference coaxial with the tubular body at a distance of 180 degrees from said first set of straight cutting blades (SA) and wherein the leading eccentric reamer stage (3B) comprises a second set of straight cutting blades (SB) and a second set of straight drift blades (6B), said second set of straight drift blades (6B) being positioned along a circumference coaxial with the tubular body at a distance of 180 degrees from said second set of straight cutting blades (SB).

3. The one-piece construction multi-functional wellbore conditioning system in accordance with claim 2, wherein each cutting blade of said first and second sets of straight cutting blades (SA), (SB) is parallel to the longitudinal axis X of the tubular body and has on its surface deep helical grooves, said grooves defining crowns, said crowns having at least one cutting element on top and with a flow-by channel formed between each of said cutting blades (SA), (SB), where the bottoms of the grooves stand proud of the surface of flow-by channels.

4. The one-piece construction multi-functional wellbore conditioning system in accordance with claim 3, wherein the cutting element is a polycrystalline diamond compact (PDC) cutter insert or tungsten carbide insert (TCI).

5. The one-piece construction multi-functional wellbore conditioning system in accordance with claim 4, wherein each set of the first set of straight cutting blades (SA) and the second set of straight cutting blades (SB) comprises in the rotational direction of the trailing and the leading eccentric reamer stages a first cutting blade and a second cutting blade where the cutting elements of the first cutting blade define with their outermost surface an ideal cylinder having a diameter d1, and the cutting elements of the second cutting blade define with their outermost surface an ideal cylinder having a diameter d2, wherein $d2<d1$.

6. The one-piece piece construction multi-functional wellbore conditioning system in accordance with claim 5, wherein each set of the first set of straight drift blades (6A) and the second set of straight drift blades (6B) comprises two drift blades adapted to provide a plastering effect on the wellbore, where each of said two drift blades defines with its outermost surface an ideal cylinder having a diameter d3, where $d3<d2<d1$.

7. The one-piece construction multi-functional wellbore conditioning system in accordance with claim 6, wherein the first cutting blade (SB) of the leading eccentric reamer stage (3B) comprises a combination of PDC and TCI inserts, where the TCI inserts being two types of inserts, i.e. large TCI inserts and smaller TCI inserts, said large TCI inserts being larger than the smaller TCI inserts, and where the large TCis inserts, the smaller TCis inserts and the PDCs inserts have different heights (h) measured from the outer surface of the first leading cutting blade (SB), where the height (h1) of the large TCis inserts is greater than the height (h2) of the smaller TCis inserts, and the height of the smaller TCis is greater than the height (h3) of the PDCs inserts, namely $h1>h2>h3$.

8. The one-piece piece construction multi-functional wellbore conditioning system in accordance with claim 2, wherein the cutting blades (SB) of the leading eccentric reamer stage (3B) comprise a combination of PDC and TCI inserts on top of their surface, while the cutting blades (SA) of the trailing eccentric reamer stage (3A) comprise only TCI inserts on top of their surface.

9. The one-piece construction multi-functional wellbore conditioning system in accordance with claim 2, wherein each drift blade of said first and second sets of straight drift blades (6A), (6B), each cutting blade of said first and second sets of straight cutting blades (SA), (SB) and each stabilizing blade of the plurality of first, second and center stabilizing blades (8), (9), (10) has with respect to a direction of rotation a leading edge and a trailing edge, where said edges have different radii of curvature.

10. The one-piece construction multi-functional wellbore conditioning system in accordance with claim 1, wherein each stabilizing blade of the drill cuttings agitator (4) is straight and is aligned along the longitudinal X axis.

11. The one-piece construction multi-functional wellbore conditioning system in accordance with claim 1, wherein each stabilizing blade of the plurality of first (8) and second (10) stabilizing blades has an elongated shape, a front section, a back section, and a central section, and an upper surface having the shape of a dome defining the contact area, and side walls, where said upper surface slopes downwards near and towards the end of the front section and also near and towards the end of the back section till it meets the surface of said cylindrical body part forming this way a toe and heel having angled faces with different angles measured from the surface of the tubular body in the longitudinal direction X, namely a first angled face T1, a second angled face T2, and a third angled face T3, where the angle of the first angled face T1 is greater than the one of the second angled face T2, and the angle of the second angled face T2 is greater than the one of the third angled face T3.

12. The one-piece construction multi-functional wellbore conditioning system in accordance with claim 1, wherein blades in the leading eccentric reamer stage, all blades of the drill cuttings agitator and blades in the trailing eccentric reamer stage are offset at 45 degrees in respect of the preceding or the following blades along the longitudinal axis X of the tubular body forming this way oblique flow-by channels in respect of the longitudinal axis X.

13. The one-piece construction multi-functional wellbore conditioning system in accordance with claim 1, wherein the hydrodynamic flutes (7) are in the form of two diverging paths at the front and back with an ellipse shaped channel between said diverging paths, where said diverging paths are adapted to create at the front of the hydrodynamic flutes (7) an inlet for the drilling fluid entering from between the plurality first stabilizing blades (8) and the plurality of center stabilizing blades (9), respectively and an outlet at the back of the hydrodynamic flutes.

14. The one-piece construction multi-functional wellbore conditioning system in accordance with claim 1, wherein the tubular body is divided into sections along a longitudinal axis X of the tubular body, where a frustoconical element having an inclination of 15-20 degrees with respect to the longitudinal axis X is formed between two consecutive sections in the longitudinal direction of the tubular body.

* * * * *